United States Patent [19]

Bacon et al.

[11] Patent Number: 4,901,545

[45] Date of Patent: Feb. 20, 1990

[54] SELF-CONTAINED ELECTROMECHANICAL LOCKING DEVICE

[75] Inventors: Michael E. Bacon; Scott W. Morneweck, both of Greenville, Pa.; Roger C. Keith, Euclid; Arvin B. Simon, Lorain, both of Ohio

[73] Assignee: Rising Star Technologies (a partnership), Greenville, Pa.

[21] Appl. No.: 138,918

[22] Filed: Dec. 28, 1987

[51] Int. Cl.[4] ..... E05B 49/00

[52] U.S. Cl. ..... 70/278; 70/214; 70/207; 70/215; 70/285

[58] Field of Search ..... 70/277-279, 70/284, 285, 330, 207, 209, 213-216, 224, DIG. 31, DIG. 59

[56] References Cited

U.S. PATENT DOCUMENTS

| | | | |
|---|---|---|---|
| 1,238,134 | 8/1917 | Greif | 70/214 X |
| 1,270,372 | 6/1918 | Breirather | 70/214 |
| 1,530,861 | 3/1925 | Standen | 70/214 X |
| 1,695,518 | 12/1928 | Watson . | |
| 2,059,678 | 11/1936 | Briggs | 70/216 X |
| 2,449,711 | 9/1948 | Milligan | 70/215 |
| 2,700,886 | 2/1955 | Welch | 70/216 |
| 3,123,995 | 3/1964 | Russell et al. | 70/216 |
| 3,395,557 | 8/1968 | Berkowitz | 70/285 |
| 3,447,347 | 6/1969 | Kawamura | 70/213 |
| 3,494,157 | 2/1970 | Coker, Jr. | 70/276 |
| 3,529,454 | 9/1970 | Fish | 70/278 |
| 3,616,667 | 11/1971 | McGourty | 70/285 |
| 3,670,538 | 6/1972 | Curry | 70/277 X |
| 3,764,859 | 10/1973 | Wood et al. | 317/134 |
| 3,787,812 | 1/1974 | Armstrong | 70/278 X |
| 3,894,417 | 7/1975 | Taniyama | 70/156 |
| 4,027,508 | 6/1977 | McGourty | 70/214 |
| 4,148,092 | 4/1979 | Martin | 70/278 |
| 4,308,732 | 1/1982 | Hau | 70/207 X |
| 4,393,672 | 7/1983 | Gelhard | 70/277 |
| 4,452,059 | 6/1984 | Sornes | 70/278 |
| 4,458,512 | 7/1984 | Gelhard | 70/277 |
| 4,637,237 | 1/1987 | Witkowski et al. | 70/214 X |
| 4,656,851 | 4/1987 | Leek et al. | 70/277 |
| 4,745,784 | 5/1988 | Gartner | 70/278 X |
| 4,748,833 | 6/1988 | Nagasawa | 70/214 |
| 4,763,937 | 8/1988 | Sittnick, Jr. et al. | 70/277 X |
| 4,770,012 | 9/1988 | Johansson et al. | 70/277 X |
| 4,799,371 | 1/1989 | Duncan | 70/214 |

*Primary Examiner*—Gary L. Smith
*Assistant Examiner*—Suzanne L. Dino
*Attorney, Agent, or Firm*—Michael Sand Co.

[57] ABSTRACT

An electromechanical locking device completely contained within a doorknob which can be a part of a usual lockset or retrofitted on an existing lockset which requires entry of an access code or entry of both an access code and use of a mechanical key for operating the lock. The code is entered on a keypad exposed on the knob and supplies a signal to a computer powered by batteries. A correct match of the input code to a code stored in the computer will actuate a motor operated cam to release a mechanical interlocking pin enabling the lock cylinder to be rotated to the unlocked position. Both visual and audible signals may be provided in the doorknob as to the power level of the batteries and ready condition of the lock. The mechanical interlock pin is disengaged automatically from the lock cylinder upon the power level of the batteries dropping to a predetermined level requiring only mechanical key operation of the lock.

34 Claims, 10 Drawing Sheets

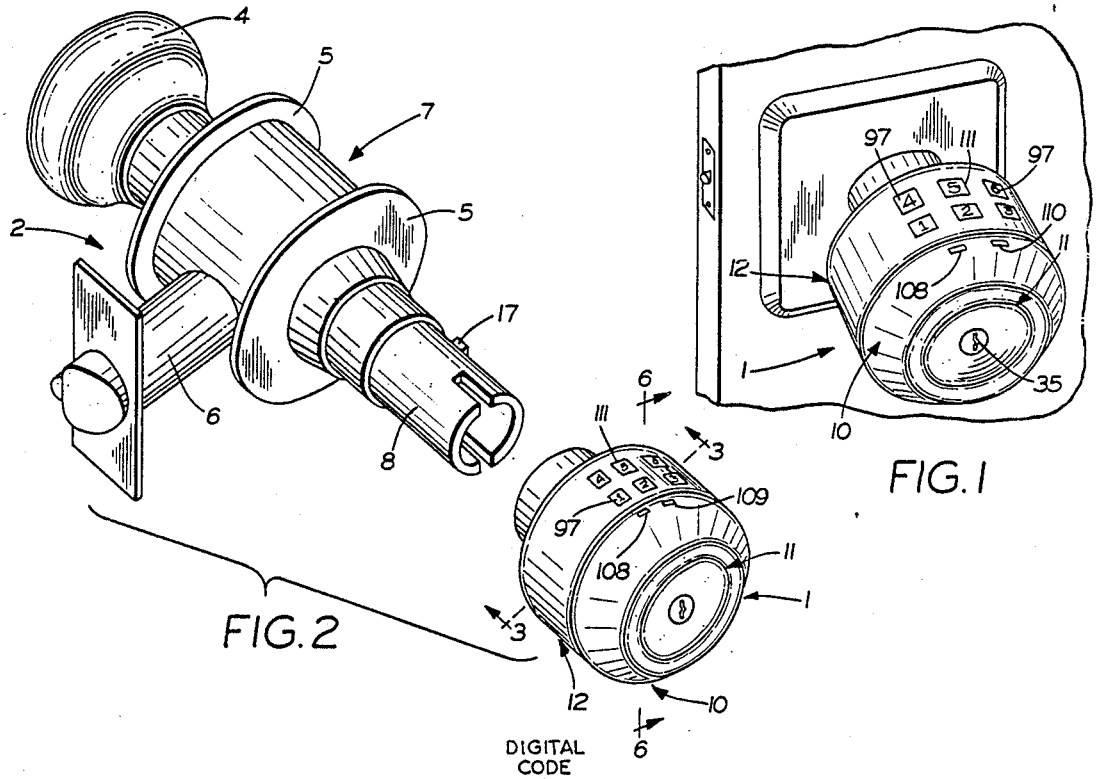
FIG. 1
FIG. 2
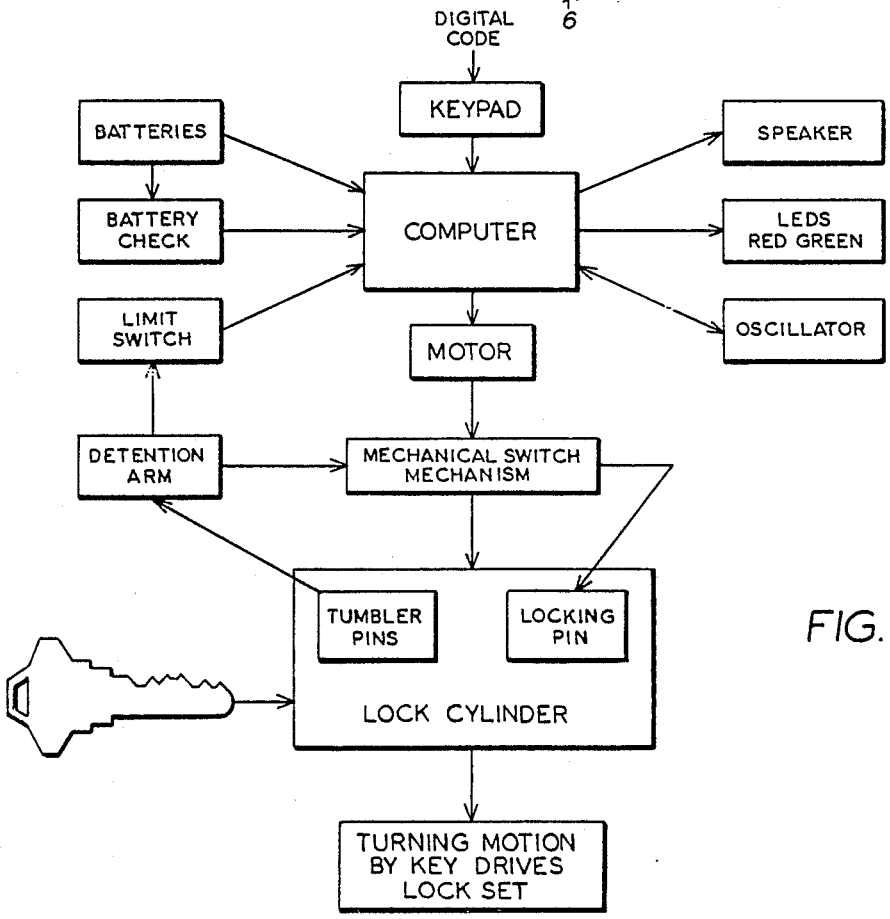
FIG. 11

SELF-CONTAINED ELECTROMECHANICAL LOCKING DEVICE

TECHNICAL FIELD

The invention relates to electronically controlled locking mechanisms. More particularly the invention relates to an electromechanical locking device which is computer controlled and completely contained within a conventional doorknob. Even more particularly, the invention relates to such a self-contained locking device having a key actuated tumbler locking mechanism in combination with a user actuated preprogrammed electronic control system.

BACKGROUND ART

Security for doors has become an increasing problem especially for certain types of businesses, such as office buildings and hotels where the occupancy of a particular secured room changes frequently requiring either installation of new locks or rekeying of existing locks in order to provide a completely secured door. Otherwise, if left unattended it would enable unauthorized previous users of the premises to gain access through the door easily by use of a previously owned key or duplicate thereof. In order to eliminate such problems, various types of security locks have been devised which incorporate various types of electronic devices which can be programmed for rapid change of an access code. However, these prior art electronic locks require holes to be cut into the door, mounting plates attached, installation of wiring and other time consuming and costly adaptations in order to incorporate them into an existing lockset. It is desirable for such electronic locks that the lock can be used both electronically with a code and/or mechanically with a key or a combination of both. In known electronic locks using batteries as the power source for the electronic components, problems occur in that, when the batteries become low a warning light or signal is usually emitted to enable the occupant to change batteries. However, should the lock go unattended in this low power condition and the batteries lose sufficient power for operation of the lock, the occupant could be locked out of the premises since the lock becomes inoperative until the batteries are replaced. It is also undesirable for the occupant to hurry and replace batteries at inconvenient times. Another known problem with existing electronic locks using a battery source is that the battery is used as the power source to drive a motor for moving the locking bolt and, therfore, uses a susbstantial amount of power which reduces the life of the battery.

The most pertinent known prior art electronic locks to our invention are shown in U.S. Pat. Nos. 1,695,518; 3,494,157; 3,670,538; 3,764,859; 3,787,812; 3,894,417; 4,393,672 and 4,458,512. However, all of these prior devices require special modifications to an existing door lockset, or require a completely new lock to be installed in the door and associated doorframe. None of these devices discloses an electromechanical locking device which is self-contained within a doorknob which is easily retrofitted on an existing lockset by removing one of the existing doorknobs and slideably inserting the doorknob on the existing lockset without any further modifications to the lockset or surrounding locking hardware. Other known prior art locking devices and security systems using electronic components, individually or in combination with a mechanical locking device, are shown in the following U.S. Pat. Nos. 3,134,254; 3,392,558; 3,392,559; 3,408,838; 3,411,046; 3,415,087; RE 27,013; 3,733,862; 3,845,362; 3,926,0212; 4,200,227; 4,209,782; 4,250,533; 4,286,305; 4,507,944; 4,519,228; 4,534,194., 4,548,061; 4,565,080; 4,616,491 and 4,626,848.

DISCLOSURE OF THE INVENTION

Objectives of the invention include providing an improved self-contained electromechanical locking device in which all of the components, including the power source, are mounted within a usual doorknob which can be retrofitted easily on an existing lockset already mounted on a door by removing one of the doorknobs and replacing it with the new locking device without any wiring, drilling of holes, or other modifications being required to the existing door or door frame, and in which the locking device enables the remaining portions of the lockset to remain and be used, eliminating the complete removal and replacement of the lockset; and in which an occupant subsequently replaces the electromechanical lock of the invention with a usual mechanical lock at a later date, if desired, again without any additional modifications to the lockset.

Another objective of the invention is to provide such an improved locking device which uses a usual key actuated, pin tumbler lock cylinder which is coupled with an electronically actuated mechanical switch lock, essentially providing two separate locks, one mechanically actuated and the other electronically actuated, thereby providing a double security lock. A further objective is to provide such a lock in which both the mechancial and electronic elements of the door lock have to be actuated in order for the door to be unlocked requiring a key for the mechanical element and a code entered through a keypad on the knob for the electronic element, and in which unauthorized personnel having only one or the other will not be able to open the lock.

A further objective of the invention is to provide such an improved lock in which when the batteries, self-contained within the doorknob, reach a predetermined low power level, a warning is provided for a predetermined number of uses after which the electronic security element will disable itself until the batteries are replaced thereby allowing the lock to function as a conventional mechanical pin tumber lock by bypassing the electronic components preventing the lock from becoming inoperable until the batteries are replaced as in some known prior art electronic locks.

A further objective of the invention is to provide such an improved locking device in which the batteries drive a motor which functions as a mechanical switch and not for driving a locking mechanism as in prior devices, thereby requiring a minimum power usage for operation of the lock and providing maximum battery life.

Another objective is to provide such an improved locking device in which a keypad is provided on the knob for entering an authorized code which is electrically connected to a computer for checking the authenticity of the entered code, which keypad is mounted on the doorknob in an unobtrusive manner.

Still another objective of the invention is to provide such an improved locking device in which a visual indication is given by a pair of LEDs as to the condition of the lock and the acceptance or nonacceptance of the code once entered on the keypad. A still further objective of the invention is to provide such an improved locking device in which the authorization code can be changed easily by reprogramming the computer, also located within the doorknob, by various methods and equipment well known in the art, thereby enabling the code to be changed repeatedly as would be required or desirable in hotel operations; and in which the key operated tumblers also can be changed by usual mechanical lock procedures.

A further objective is to provide such a locking device which can be code actuated, electronically controlled and actuated mechanically for unlocking the door without requiring a key.

These objectives and advantages are obtained by the improved locking device of the invention the general nature of which may be stated as including an electromechanical locking device completely contained within a doorknob of the type adapted to be fitted on an input shaft of a key actuated lockset, said device including a self-contained power source; key actuated mechanical locking means for rotating a locking cylinder from locked to unlocked position; first means for generating a first signal in response to an entered code; second means for generating a second signal in response to the first signal; and interlock means operable in response to the second signal for permitting unlocking of the mechanical locking means by a key.

BRIEF DESCRIPTION OF THE DRAWINGS

Preferred embodiments of the invention, illustrative of the best modes in which applicants have contemplated applying the principles, are set forth in the following description and are shown in the drawings and are particularly and distinctly pointed out and set forth in the appended claims.

FIG. 1 is a fragmentary perspective view of a door with the self-contained locking device of the invention shown mounted thereon;

FIG. 2 is a perspective view, portions of which are shown in exploded condition, of a lock set with the self-contained lock incorporated into one of the knobs for on the lock set;

FIG. 11 is a block diagram system flow chart of the cooperation and sequence of events for operating the improved self-contained lock of the invention;

Similar numerals refer to similar parts throughout the drawings.

BEST MODE FOR CARRYING OUT THE INVENTION

Figure 3:
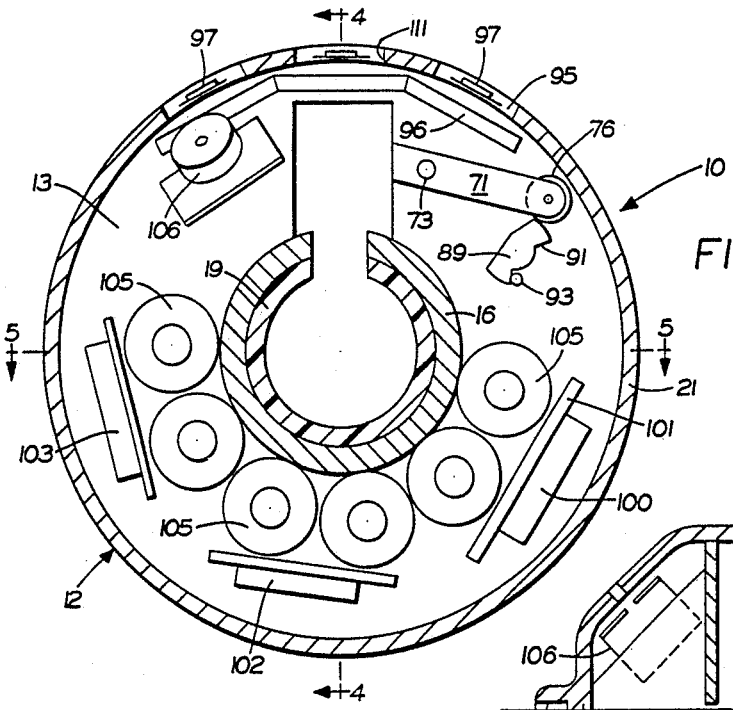
FIG. 3 is a vertical section taken on line 3—3, FIG. 2, showing in diagrammatic fashion certain of the components of the improved self-contained lock.

The improved self-contained electromechanical lock of the invention is indicated generally at 1, and is shown in FIGS. 1 and 2, associated with a usual door lockset indicated generally at 2, mounted on a door 3. Lockset 2 includes a usual inside doorknob 4, a pair of mounting flange plates 5, a locking bolt 6 which is controlled by an internal locking mechanism indicated generally at 7, which includes a usual outwardly projecting sleeve 8 for slideably receiving a usual outside knob thereon.

Figure 4:
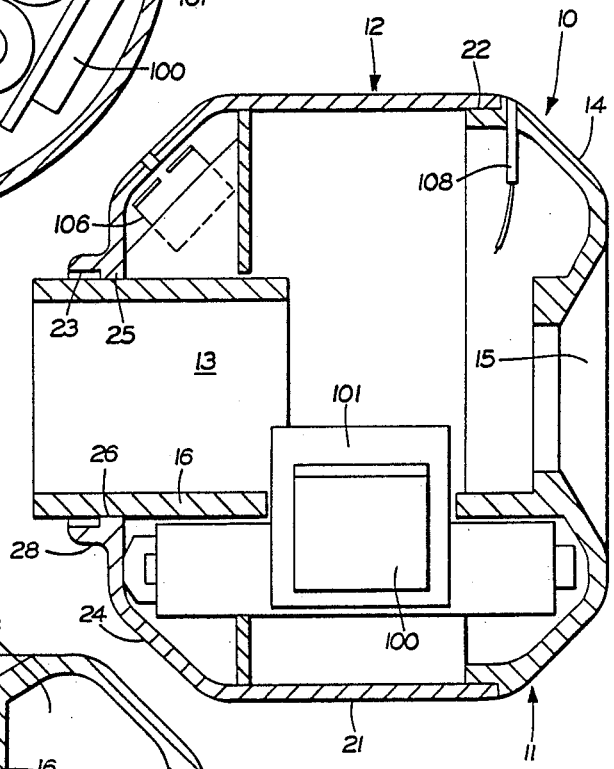
FIG. 4 is a diagrammatic sectional view taken on line 4—4, FIG. 3.
Figure 6:
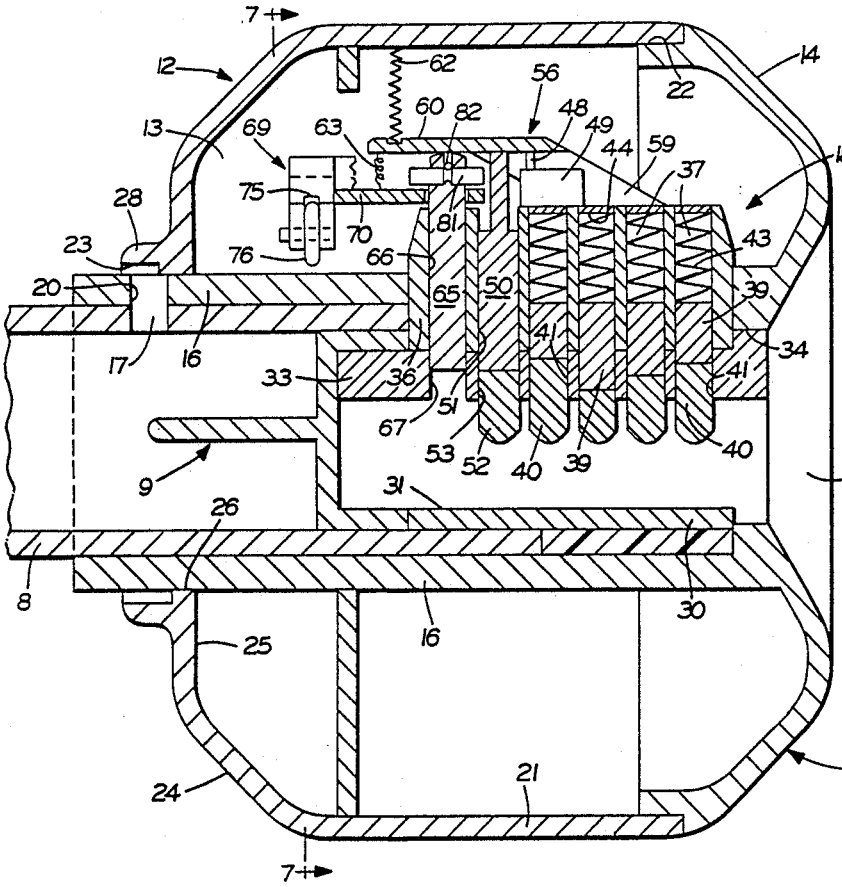
FIG. 6 is a sectional view taken on line 6—6, FIG. 2, showing the self-contained lock in a locked position.
Figure 7:
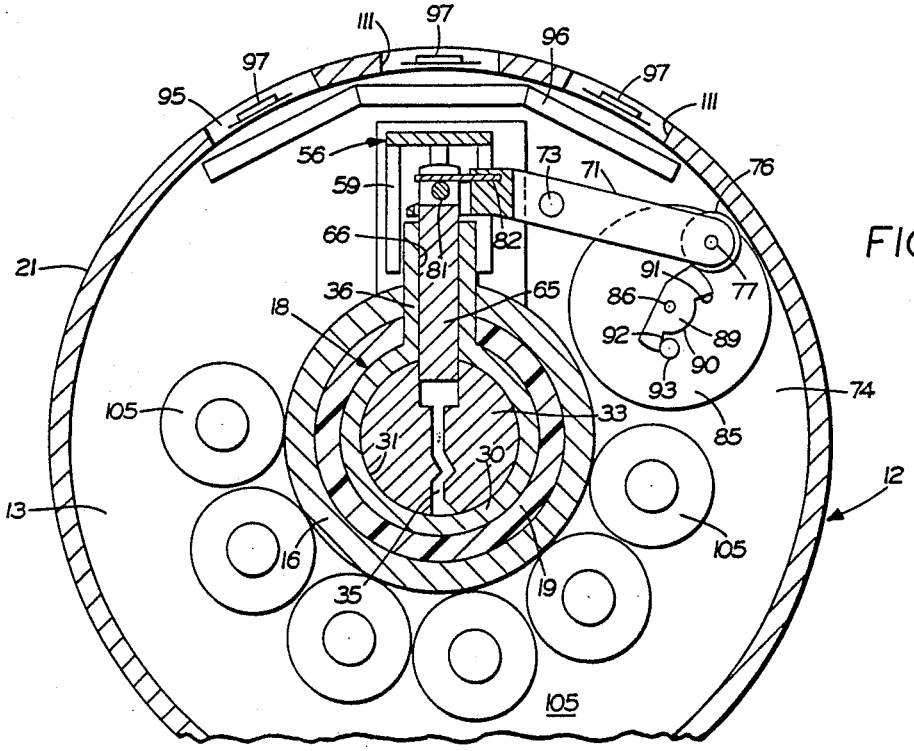
FIG. 7 is a fragmentary sectional view taken of line 7—7, FIG. 6.

In accordance with one of the main features of the invention, the improved self-contained locking device 1 is contained entirely within a usual doorknob indicated generally at 10. Furthermore, knob 10 is adapted to be retrofitted on a usual lockset sleeve 8, with the internal locking hub engageable with the internal locking mechanism 7 in a usual manner for operating locking bolt 6 such as by a tail piece 9 as shown in FIG. 6. Referring particularly to FIGS. 3 and 4, doorknob 10 has a generally cylindrical configuration similar to usual doorknobs and is formed by front and rear housings indicated generally at 11 and 12, respectively, forming an interior compartment 13. Front housing 11 includes a front annular portion 14, which forms an end conical recess 15 and has an internal cylindrical wall 16 in which is slideably received a tumbler assembly indicated generally at 18 (FIGS. 6 and 7). Tumbler assembly 18 is retained within wall 16 by an intervening compression retainer sleeve 19. Back housing 12 includes a generally cylindrical sidewall 21, the outer annular end of which is seated within an annular shoulder 22 formed in the terminal end of front housing curved sidewall portion 14. The other end of cylindrical housing wall 21 terminates in an inwardly extending conical wall section 24 which terminates in a straight wall section 25 formed with a central opening 26. Cylindrical wall 16 of front housing 11 extends through central opening 26 (FIG. 4). An annular flange 28 extends outwardly from end wall 25 and surrounds cylindrical wall 16 at a spaced relationship forming an annular groove 23 for receiving the end of lockset sleeve 8 when in the assembled position as shown in FIG. 1. Front and back housings 11 and 12, preferably are formed of metal and may have other shapes and configurations than that shown in the drawings and described above without affecting the concept of the invention. Knob 10 is secured in sleeve 8 by a pin 17 projecting through a hole 20 formed in cylindrical wall 16.

Tumbler assembly 18 (FIGS. 6 and 7) includes a cylindrical body 30 having a bore 31 in which a cylinder plug 33 is slideably rotatably mounted. The front end of plug 33 is formed with a keyhole slot 35 and has an annular flange 34 which abuts against the outer end of cylindrical body 30 to properly seat plug 33 therein. Tail piece 9 is secured to the rear end of plug 33 so as to rotate therewith for actuating the locking mechanism of a usual lockset. Cylinder body 30 is formed with an upstanding section 36 which extends through housing wall 16 and is formed with a plurality of radially extending apertures 37, six of which are shown in the particular embodiment of the drawings. The front four apertures 37 each have a driver pin 39 slideably mounted therein which are biased into engagement with an associated tumbler pin 40 by a coil spring 43. Pins 40 are slideably mounted in aligned apertures 41 formed radially in cylinder plug 33. Springs 43 are maintained within apertures 37 by end caps 44.

The construction and operation of driver pins 39 and associated tumber pins 40 is the usual arrangement present in most tumbler-pin type locks. The outer ends of pins 40 are adapted to be received within correspondingly aligned bittings or grooves 46 formed in an edge of a usual key 47, as shown particularly in FIG. 9. A detention arm pin 50 is slideably mounted in a fifth aperture 51 formed in tumbler assembly section 36, and engages a fifth tumbler pin 52 which is slideably mounted in a fifth tumbler pin aperture 53, the extended end of which is also adapted to be engaged by a forward bitting 54 formed in the edge of key 47. The upper end of detention arm pin 50 abuts a pin detention arm indicated generally at 56, one end of which is pivotally mounted by a pin 57 on upstanding section 36 of cylinder body 30. Pin detention arm 56 includes a pair of spaced legs 59, which straddle upstanding section 36, and which are connected thereto by pivot pin 57. Legs 59 terminate in a forward arm portion 60 which is abutted by the upper end of detention arm pin 50. Detention arm 56 is biased in a downwardly direction into engagement with pin 50 by a compression coil spring 62 and by a tension coil spring 63 and also depresses a plunger 48 of a limit switch 49.

Figure 8:
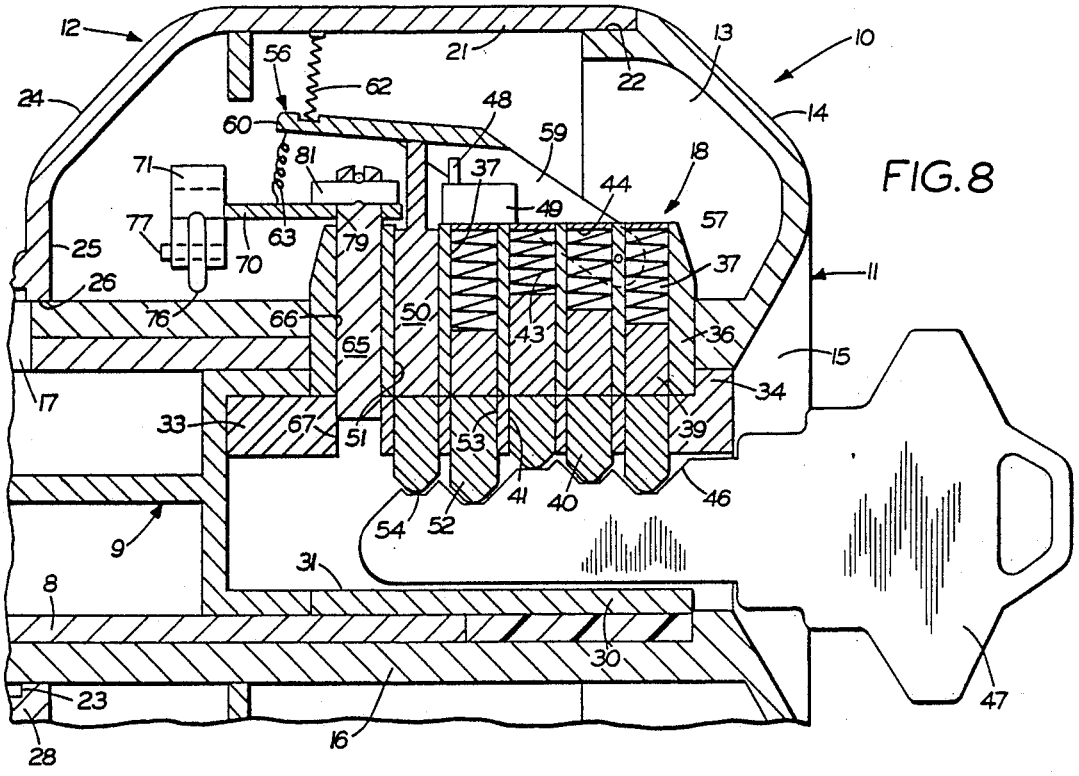
FIG. 8 is an enlarged fragmentary sectional view similar to FIG. 6 showing a key inserted into the tumbler assembly prior to unlocking the lock by the memory control unit.

A locking pin 65 is slideably mounted in the sixth aperture 66 which is formed in upstanding section 36 of cylinder body 30. Pin 65 extends into an aperture 67 formed in cylinder plug 33 when in the locked position as shown in FIGS. 6 and 8. There is no correspondingly aligned tumbler pin as in the first five apertures of the cylinder plug.

Figure 5:
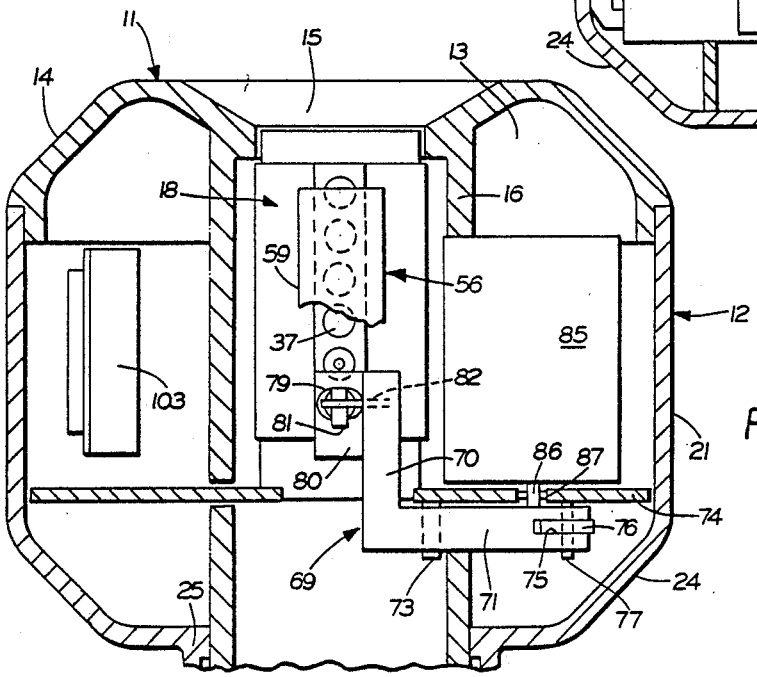
FIG. 5 is a diagrammatic sectional view taken on line 5—5, FIG. 3.

Referring particularly to FIGS. 5 and 6 which show the tumbler assembly in a usual locked position, a lever arm, indicated generally at 69, is pivotally mounted by a pivot pin 73 onto an end plate 74 which is mounted within doorknob housing compartment 13 and extends between cylindrical sidewall 21 and internal cylindrical wall 16. Arm 69 consists of a longitudinally extending section 70 and a transversely extending cam arm section 71. One end of cam arm section 71 is formed with a slot 75 in which a cam roller 76 is mounted by a pin 77. The top end of locking pin 65 extends through a complementary-shaped hole 79 formed in an off-set end 80 of lever arm section 70 and is secured therein by a retainer pin 81 and a retainer guide pin 82 which is snap-fitted into a groove 83 formed in the top end of locking pin 65. Tension spring 63 is connected to and extends between forward arm portion 60 of pin retention arm 56 and locking pin arm section 70.

A motor 85 is mounted within housing compartment 13, as shown in FIG. 5, with its shaft 86 extending through an opening 87 formed in end plate 74. Shaft 86 is connected to an irregularly-shaped rotatable cam 89 which has an arcuate cam surface 90 (FIG. 7).and a pair of cam stop surfaces 91 and 92 which alternately engage a cam stop 93. Stop 93 preferably is mounted in housing end plate 74 and projects outwardly therefrom (FIG. 5).

Referring particularly to FIGS. 2, 3, 4, and 7, locking device 1 further includes a keypad 95 mounted within housing compartment 13 by a key pad support 96. Pad 95 has six individual buttons 97 formed thereon, which are connected by appropriate circuitry to a computer 100, which is mounted on a support plate 101 and located within compartment 13. Computer 100 may be of the type identified as a Model uPD75104 manufactured by NEC of Japan. Computer 100 is connected by appropriate circuitry and wiring to an oscillator 102 and to a battery check circuit board 103. Oscillator 102 is a master timing control which synchronizes all computer and electronic functions. A self-contained power supply, preferably consisting of six batteries 105, which are arranged in a circular manner about front housing sleeve 16 so as to reduce the overall storage size required therefore, is electrically connected to computer 100, oscillator 102, battery check circuit 103 and the keypad 95. In addition the power supply is connected through the computer to an audible speaker 106 which is also mounted within doorknob housing compartment 13, and to a pair of light emitting diodes (LEDs) 108 and 109 mounted within the doorknob housing. LEDs 108 and 109 are visible to the exterior of the knob housing through aligned apertures 110 formed in the housing wall. Keypad switches 97 also are accessible on the exterior of the doorknob by projecting through aligned apertures 111 formed in the housing wall.

The operation of the various components and structural elements set forth above and shown in the drawings for achieving the results of the improved self-contained locking device is set forth below and is shown in block diagram form in FIG. 11.

A user of device 1 will insert a usual authorized key 47 into keyhole slot 35 which will move the first four tumbler pins 40 and associated driver pins 39 and fifth tumbler pin 52 from the locked position of FIG. 6 to the unlocked position of FIG. 8 in a usual mechanical locking manner. Detention arm pin 50 will move upwardly against pin detention arm 56 which will compress spring 62 and correspondingly tension spring 63 to apply a lifting force through spring 63 to lever arm 69. Upward movement of arm 56 will also relieve pressure on plunger 48 which will actuate limit switch 49. As shown in FIG. 7, cam roller 76 engages cam 89 preventing pivotal movement of cam arm 71, even though arm 71 is being biased upwardly by spring 63. Cylinder plug 33 remains in the locked mode, as shown in FIG. 8, due to locking pin 65 being held in locked position by lever arm 71.

Limit switch 49 is activated upon the upward movement of pin detention arm 56 which will activate computer 100 bringing it out of its "sleep mode". The computer, in turn, turns on battery check circuit 103 which evaluates the power level of batteries 105. The computer then makes a decision on a high/low signal from the battery check circuit. If a low condition is reported, the computer will check the number of uses since the first battery low condition was reported. If this number exceeds a predetermined number of uses after the first battery low report, then the computer goes back into its "sleep mode". The locking pin 65, which will have already been deactivated at this point as described below, will therefore be inoperable permitting the lock to work as a standard mechanical key lock with the electronic portion of the lock having been disabled and no signals are emitted.

Next, the computer flashes red LED 109 and beeps speaker 106 as a battery low warning to the user before going into normal operating procedures. If batteries 105 have been left below a set threshold for a predetermined number of uses, then as discussed above, the computer deactivates locking pin 65 upon the computer going into its sleep mode.

Assuming that a sufficient battery power level is determined by battery check circuit 103 which is reported to the computer, the computer will then flash green LED 108 and the beeper speaker signals the user to enter a code on keypad 95. The computer then waits for a user to enter a code on the keypad by pressing switches 97 in a predetermined numbered sequence. If a code is not entered by the user within a predetermined time period, the computer flashes red LED 109 and the speaker beeps. Beyond a set waiting time the computer will then go back into a sleep mode and the user, in order to reactivate the computer, must reinsert key 47.

In the preferred embodiment there are eighteen individual codes available that can be programmed into the computer's memory by use of a master code and procedure. Each of the eighteen codes has five entry segments and each segment, or key press, can include up to two individual buttons or switches pressed simultaneously. This will provide over 4,000,000 possible code combinations with the use of a six digit keypad as shown in the drawings of the preferred embodiment.

When keypad switches 97 are depressed the computer turns on green LED 108 and the speaker beeps for as long as the buttons are depressed. The computer then compares the user entered code with codes stored in its memory. If the user's code does not match a stored code, the computer signals the user that the code is invalid. The computer then starts and keeps count of individual code combinations for a predetermined number of times. If the preset number of invalid codes is reached, then the computer goes into its sleep mode; otherwise, if the preset number of invalid input codes is not reached then the computer begins the next phase of operation.

Figure 9:
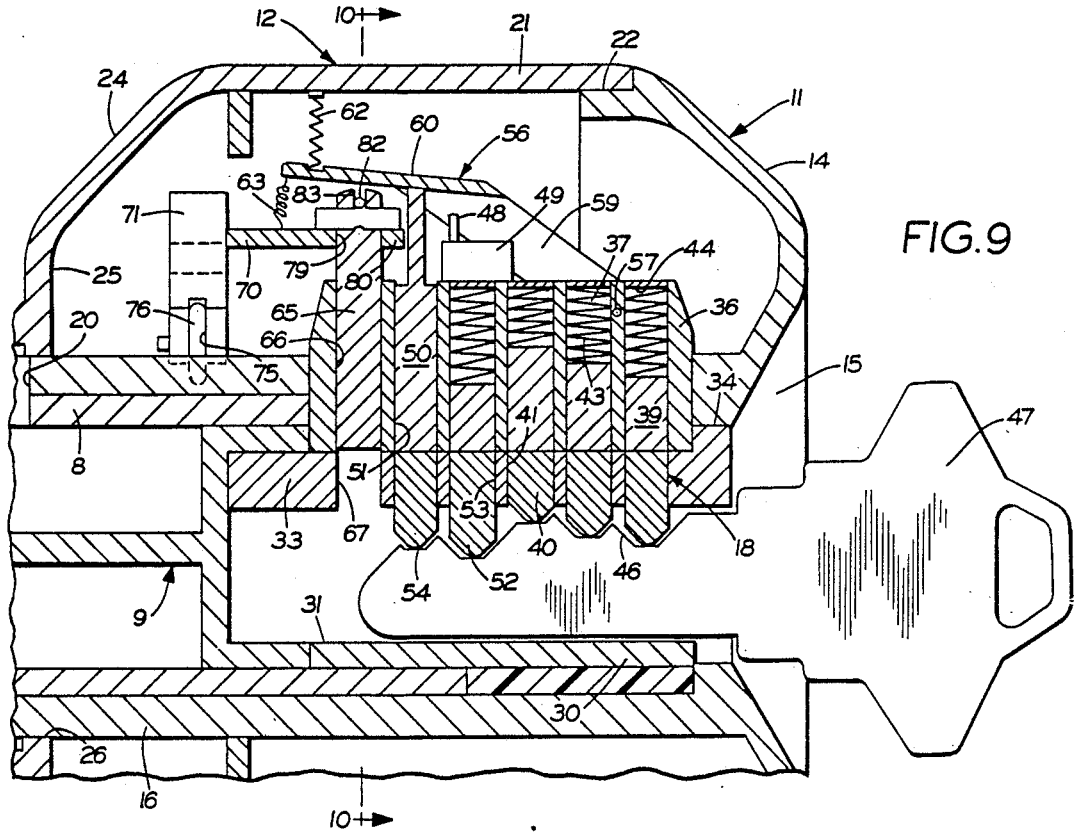
FIG. 9 is a view similar to FIG. 8 after the locking pin has been moved to the unlocked position by the control memory.
Figure 10:
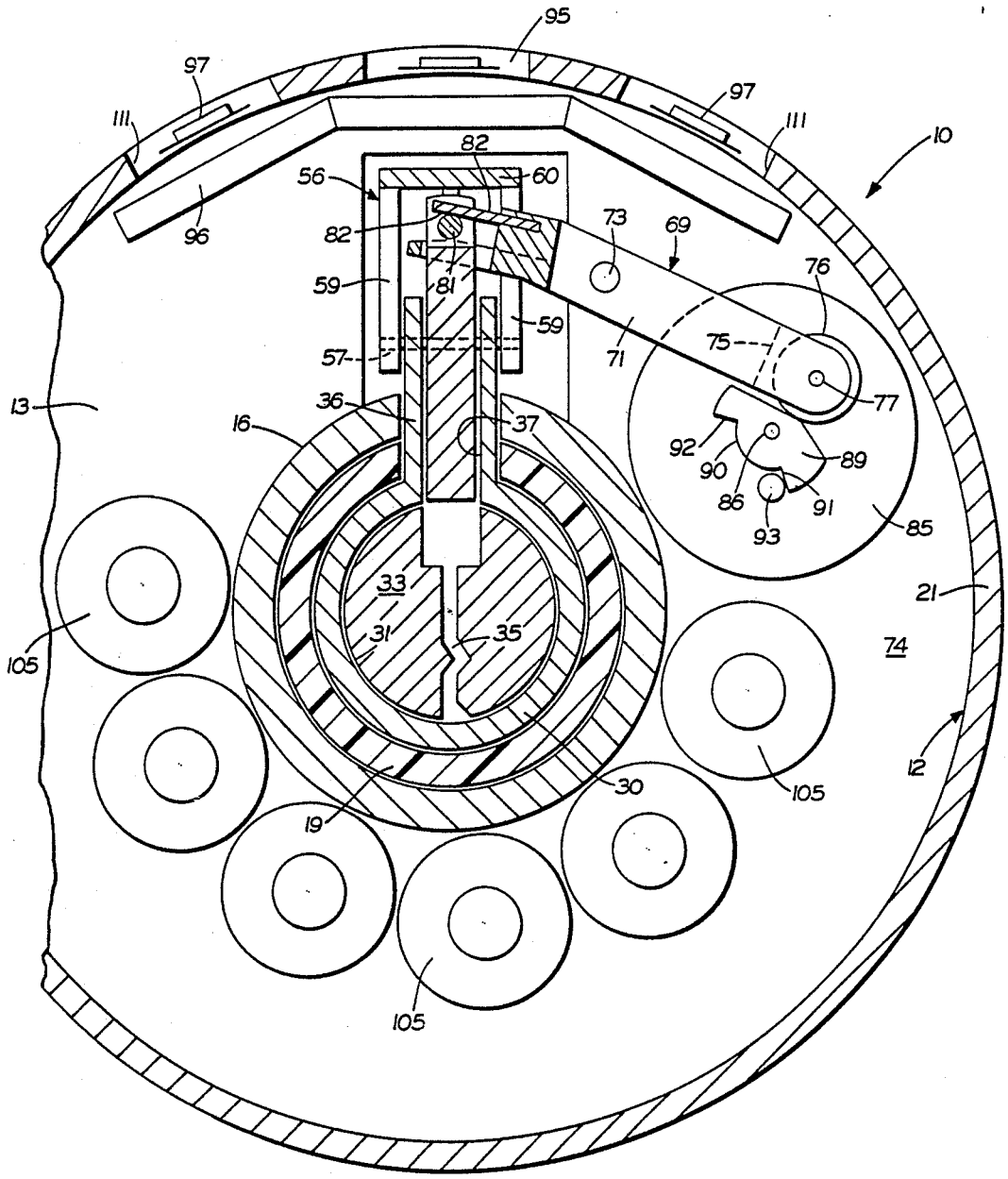
FIG. 10 is an enlarged fragmentary sectional view taken on line 10—10, FIG. 9.
Figure 12:
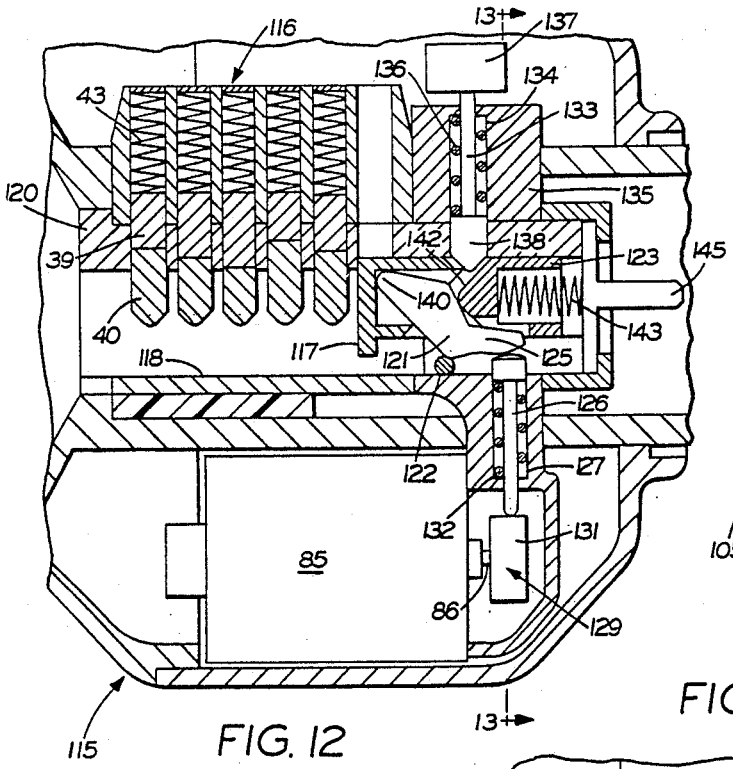
FIG. 12 is a fragmentary diagrammatic sectional view similar to FIG. 6 of a modified embodiment of the improved self contained lock in the locked position.

Upon the input code being matched with the stored code, the computer signals the user that a correct code has been entered and the computer in turn sends the appropriate signal for actuating motor 85. Upon energizing motor 85, its shaft 86 will rotate cam 89 from the locked to the unlocked position, that is, from the position of FIG. 7 wherein curved surface 90 engages cam roller 76 preventing pivotal movement of cam arm 71, to the unlocked position of FIG. 10, at which position cam stop surface 91 engages cam stop 93. This movement of cam 89 permits lever arm 69 to pivot upwardly due to the tension applied thereto by spring 62. Upward pivotal movement of lever arm 69 will pull locking pin 65 upwardly to the unlocked position as shown in FIG. 9. The cam roller will stop its pivotal movement by engagement with cam 89, when cam 89 engages stop 91 as shown in FIG. 10.

Cylinder plug 33 now is free to be turned by key 47 and is then turned to the unlocked position as in a standard mechanical door lock. Upon cylinder plug 33 being moved to the locked position from the unlocked position by key 47, and after key 47 is removed from cylinder slot 35, spring 62 will bias detention arm pin 50 into the locked position which will also return locking pin 65 to its locked position. Pin 65 merely drops into its relocked position due to the pressure applied by pin detention arm 56 applying downward pressure thereon by spring 62. This downward movement of detention arm 56 will contact plunger 48 of limit switch 49 signaling the computer that key 47 has been removed from cylinder plug 33 simultaneously with the locking movement of locking pin 65. Lever cam arm 71 pivots back to the relocked position of FIG. 7 through the direct action of the retainer pin 81 which is a part of the locking pin assembly. Also the first four tumbler pins 40 and their associated driver pins 39 return to their usual locked position by the action of springs 43.

The cam relock is dependent upon a computer decision. If the computer decides to relock, that is, the batteries are at a sufficient power level, cam motor 85 drives shaft 86 in reverse until cam stop surface 92 engages cam stop 93 (FIG. 7) which will then position curved surface 93 beneath cam roller 76. Cam 89 does not engage cam roller 76 when in the locked position, but prevents it from moving downwardly by engagement therewith as shown in FIG. 7 until motor 85 is energized by the appropriate control signal from the computer. Only when a key is inserted into the cylinder plug 33 does the cam roller move downwardly into engagement with the cam and only when the cam is in the locked position as shown in FIG. 7.

Next the computer receives a signal from limit switch 49 that the key has been removed and if the low power level is sensed by the computer, the computer will not signal motor 85 to move cam 89 to its locked position thereby enabling the lock to continue to function as a purely mechanical lock. The computer then goes into its sleep mode to await a new operational cycle.

As discussed previously, one of the features of the improved security device is that upon a low power condition existing the electronic interlock feature is disengaged enabling the lock to continue to operate as a usual mechanical tumbler pin locking device. This prevents locking out an authorized occupant as can occur in prior electronic/mechanical lock installations upon low battery power. Furthermore, another unique feature of the invention is that it provides essentially two locks, one mechanically actuated and the other electronically actuated. Therefore, even though a user has a correct key, but an incorrect code, the lock will not actuate and, correspondingly, should a user have the correct code but not the key, the device will not operate. Likewise, even should the electronic element of the lock be bypassed, the mechanical element will still function to prevent unauthorized entry. This double lock feature increases security and is convenient for the user enabling the user to replace the batteries upon a low condition being signaled at his convenience without the danger of being locked out of the premises should the battery power drop below a predetermined level.

In accordance with another feature of the invention, the batteries are used only to actuate motor 85 to rotate cam 89 which functions as a mechanical switch for permitting the pivotal movement of lever arm 69. The motor does not function to move various locking components as in some prior devices thereby requiring only a minimum amount of power drain on the batteries. Only enough power is required to rotate the cam through a limited arcuate motion and not to move the more resistive components in a lock system. The power supply to the unlocking mechanism is derived from the mechanical advantage of the key. This keeps power usage to an absolute minimum and increases and provides maximum battery life.

Furthermore, the outside of the knob appears very similar to an ordinary doorknob except for the six small keypad buttons or switches 97 which will usually be placed on the top of the knob and the two rectangular red and green LEDs 108 and 109 preferably located at the front of the knob. The knob housing will hold all of the lock components in a secure metal structure and the housing can only be disassembled after removal from the usual lockset sleeve by removing the inside knob of the lockset in a usual manner preventing unauthorized access to the interior of the knob from the outside of the door.

A modified form of the improved locking device is indicated generally at 115, and is shown particularly in FIGS. 12–15. Modified device 115 includes a usual pin tumbler assembly indicated generally at 116, which is key actuated as in a usual mechanical lock, as described above with respect to locking device 1. In addition, modified device 115 includes a key slide 117 which is axially slideably mounted within a bore 118 of a cylinder plug 120 when engaged by a rounded nose 119 of key 47. Device 115 provides a cylinder end latching system in contrast to a cylinder top latching system as described above for device 1.

Figure 13:
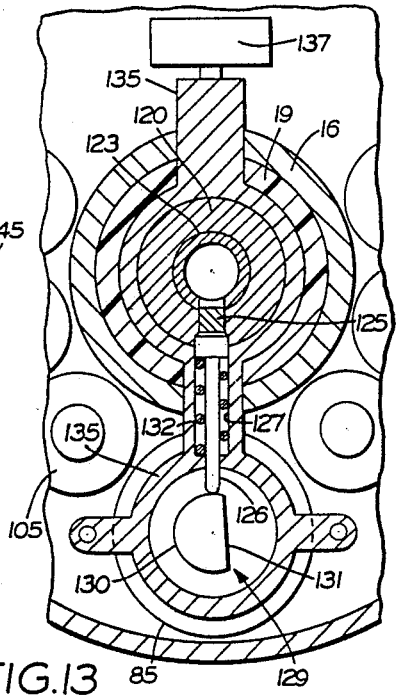
FIG. 13 is a fragmentary diagrammatic sectional view taken on line 13—13, FIG. 12.

A rocker lever 121 is slideably mounted within slots formed in key slide 117 and a spring slide 123 for engagement with key slide 117 and spaced spring slide 123. Rocker lever 121 generally floats within its mounting slots and has limited rocking movement when brought into engagement with a laterally extending pin 122 whereby a front leg 125 thereof can move downwardly against a locking pin 126. Pin 126 is slideably mounted within an aperture 127 formed in cylinder plug 120 with its inner end being engaged by a cam 129 which is formed with a curved surface 130 and a flat side 131 (FIG. 13). Locking pin 126 is biased by a spring 132 in an upward direction toward engagement with rocker lever leg 125. Cam 129 is rotated by shaft 86 of motor 85 as in locking device 1.

A limit switch pin 133 is slideably mounted within an aperture 134 formed in pin-tumbler assembly housing 135 and is biased downwardly into engagement with key slide 117 by a spring 136. The upper end of switch pin 133 engages the plunger of a limit switch 137 which is similar to limit switch 49 of locking device 1. The lower end or nose 138 of pin 133 has an angled surface which engages a corresponding angled surface on the front annular edge of key slide 117. A rear leg 140 of rocker lever 121 is engaged with key slide 117. Spring slide 123 includes a rounded front nose 142 which is biased into engagement with rocker lever 121 by a compression coil spring 143. A tail piece 145 is firmly attached to cylinder plug 120 so as to rotate therewith. Tail piece 145 extends into the usual locking mechanism of a standard lockset whereupon rotation of cylinder plug 120 and tail piece 145 will unlock the lockset locking mechanism.

The operation of modified locking device 115 is as follows. The various components described above assume the positions as shown in FIG. 12 when in locked position, wherein the various tumbler pins extend through the appropriate apertures in cylinder plug 120 preventing rotation of the plug as in a usual mechanical lock. In the locked position, rocker lever 121 assumes the position shown in FIG. 12 and locking pin 126 being in its raised position against front leg 125. Pin 126 is prevented from downward movement by engagement with rounded surface 130 of cam 129 as shown in FIG. 13. Also, limit switch pin 133 is engaged with the tapered annular edge of key slide 117 and spring slide 123 is engaged with rocker lever 121.

Figure 14:
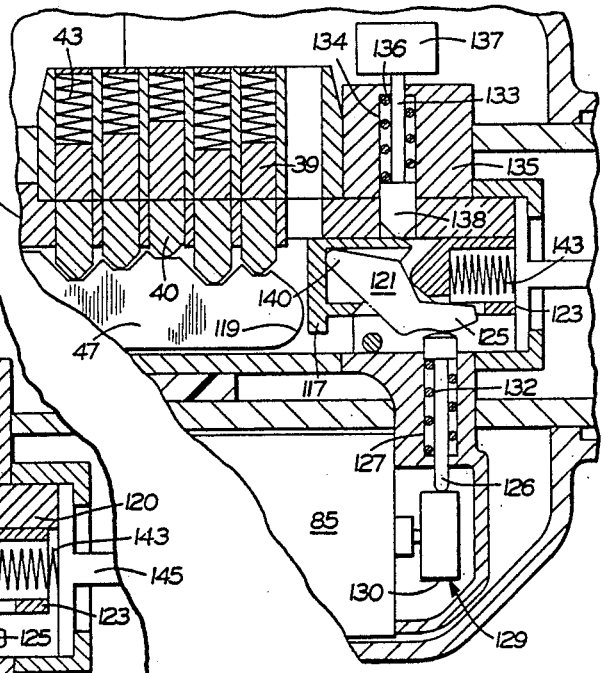
FIG. 14 is a fragmentary diagrammatic sectional view similar to FIG. 12 with a key being engaged with the tumbler pins prior to the locking pin being moved to an unlocked position upon a valid control signal being received.
Figure 15:
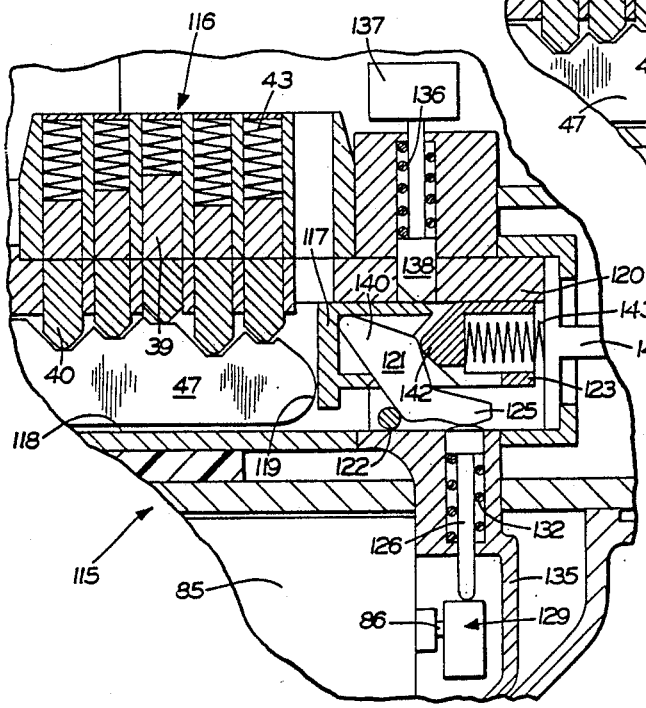
FIG. 15 is a fragmentary diagrammatic sectional view similar to FIG. 14 showing the improved self-contained lock in a fully unlocked position.

Key 47 when inserted into the cylinder plug keyslot will align the various tumbler pins as shown in FIG. 15 enabling the cylinder plug to be rotated in its usual manner. This inward movement of the key will move key slide 117 inwardly by its contact with key nose 119, that is, to the right in FIG. 12, moving limit switch pin 133 upwardly into engagement with limit switch 137 (FIG. 14). A signal is sent by limit switch 137 to computer 100 in a similar manner as described above with respect to limit switch 113. The rocker lever is pushed inwardly about pin 122 applying a downward pressure by front leg 125 against locking pin 126. This movement of rocking lever 121 also will push back spring slide 123 compressing spring 143.

The various components then assume the position of FIG. 14. Even though the tumbler pins are properly aligned to permit rotation of cylinder plug 120 its rotation is prevented by the upward extension of locking pin 126. Upon motor 85 receiving the signal from the computer indicating that a correct entry code has been inserted into keypad 95, cam 129 is rotated so that flat cam surface 131 extends horizontally permitting locking pin 126 to move downwardly by the force exerted thereon by front leg 125 of rocking lever 121 overcomming the biasing force of locking pin spring 132. The rocking lever is forced against pin 122 bringing the locking pin 126 to the disengaged position of FIG. 15 by spring slide 123 moving forward by the pressure of spring 143. The cylinder plug now can be rotated by the key which will rotate tail piece 145 and operate the associated locking mechanism of a usual lockset.

The electronics and computer control sequence is similar to that described above with respect to locking device 1 and, therefore, is not discussed in detail with respect to modified locking device 115.

Upon removal of the key from the cylinder, spring 143 pushes spring slide 123, rocker lever 121 and key slide 117 outwardly, that is, to the left of the drawing (FIGS. 14–15). As the key slide moves outward, limit switch pin spring 136 will push pin 133 downwardly coming to rest against the beveled end of key slide 117 which will actuate or disengage limit switch 137. The computer then waits for its appropriate signal to occur as discussed above, which then signals motor 85 to move cam 129 to the locked position as shown in FIG. 13. As rocker lever 121 is pushed outwardly it moves about pin 122 and locking pin spring 128 will push locking pin 126 upwardly into its relocked position extending through aperture 127 of cylinder plug 120.

Figure 16:
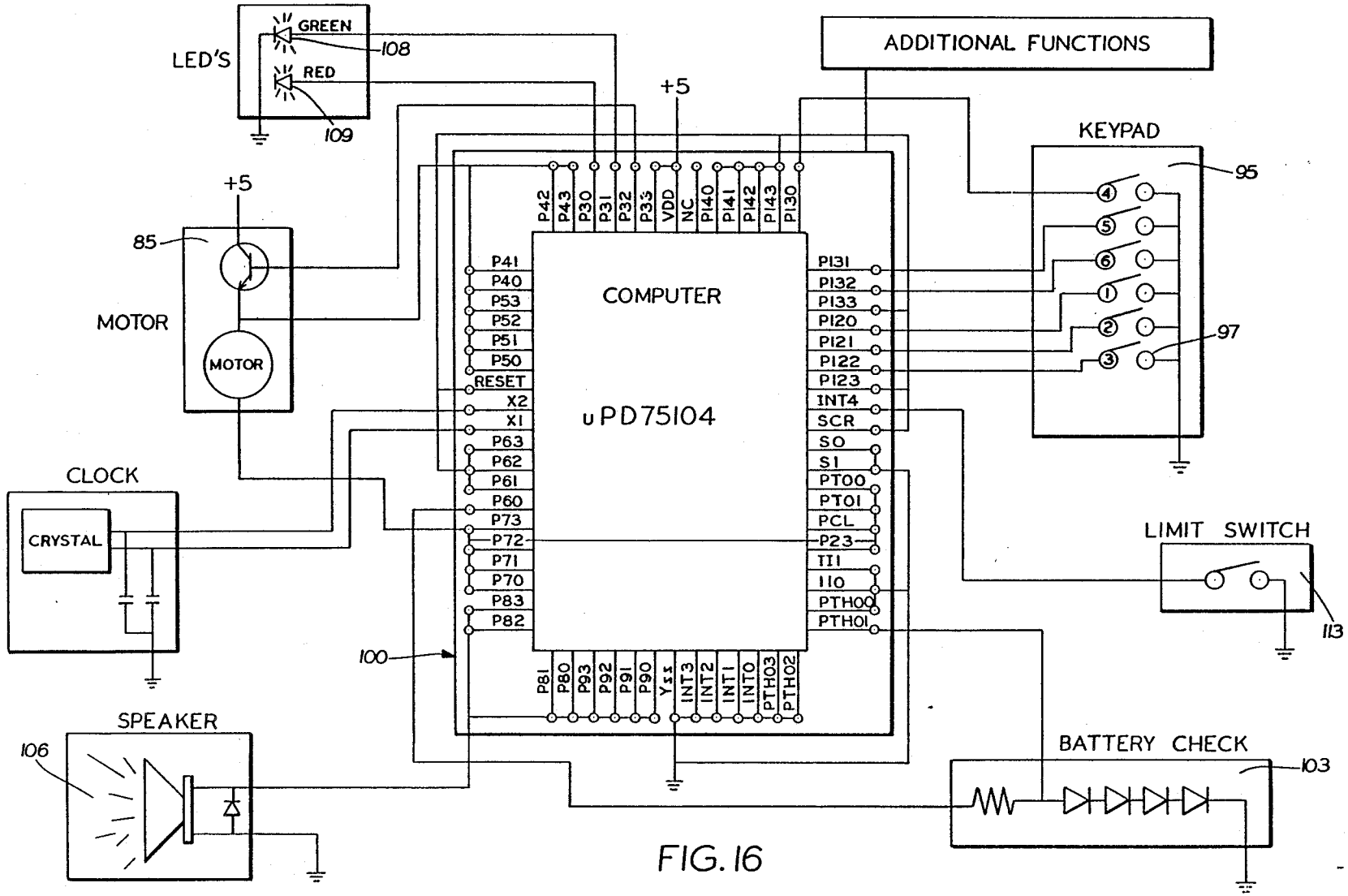
FIG. 16 is a computer block diagram showing in greater detail the control of the various components of the improved locking device.

FIG. 16 is a computer block diagram showing in greater detail the control of the various components of the improved locking device. Computer 100 functions as the brain of the locking device and is controlled by usual software well known in the art. As discussed above, when the computer is in the sleep mode the only way it can be awoken is for limit switches 113 and 137 to be closed, which happens when a key is inserted into the mechanical lock cylinder. The computer in turning on the battery check circuit 103 uses line P60 and reads the status of the batteries through line PTHO1. If the batteries are low the computer warns the user by flashing the red LED on line P30 and sounding the speaker by lines P83, P82, P81, P80, P93, P92, P91 and P90. If the power level in the batteries is sufficient, the computer signals the computer to be ready to accept key codes.

The keypad block serves as the data entry part of the circuit and it interfaces the user with the computer. Transistor 99 in the control circuit for motor 85, is turned on by line P32 which in turn allows a heavy current to flow through the transistor and motor and into lines P73, P72, P71, P70, PTOO, PTOl, PCL and P23 which are tied to ground by the software.

When the limit switch is opened, meaning the key is pulled out, the computer will relock the electronic part of the lock which is done by actuating the motor in the reverse direction as described above. Clock 98 is an additional function for the computer and can take in additional things, such as an alarm system to a remote location can be incorporated into the knob. The various other components of FIG. 16 were previously described in detail above.

Figure 19:
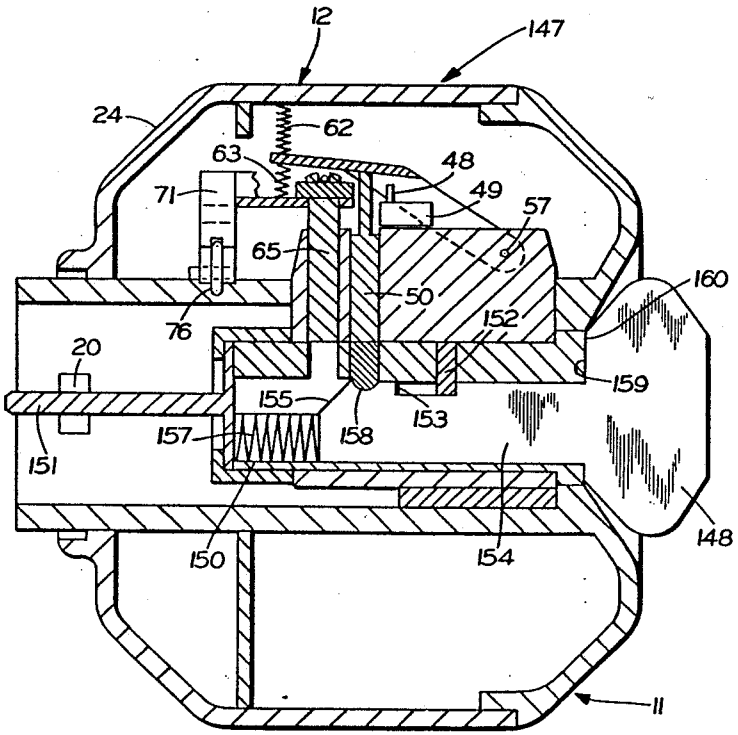
FIG. 19 is a diagrammatic sectional view similar to FIG. 17 showing the turnkey in a fully inserted position and the locking pins in unlocked position.
Figure 17:
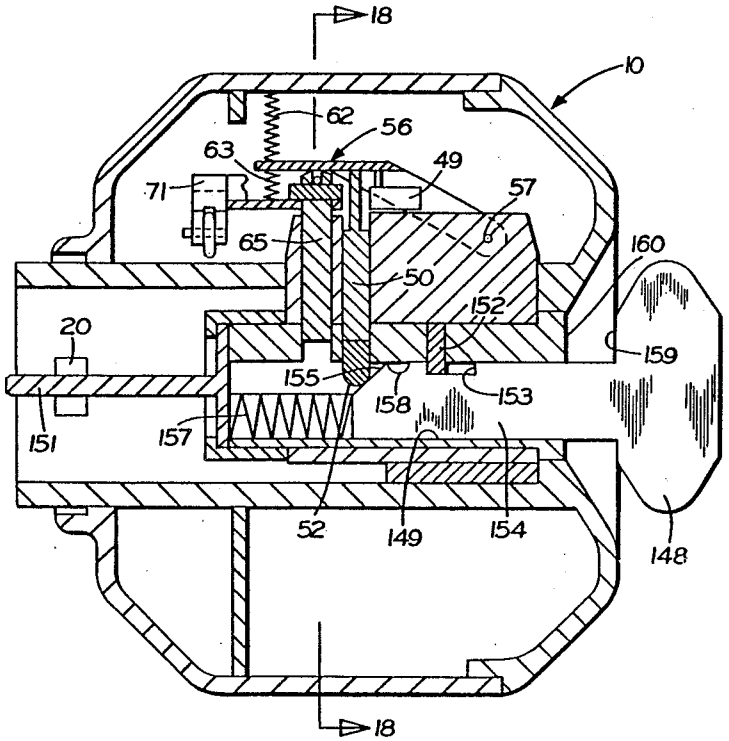
FIG. 17 is a diagrammatic sectional view similar to FIG. 8 of a third embodiment of the improved locking device shown in locked position which is electronically controlled by an access code and then mechanically actuated by a nonremovable turnkey.
Figure 18:
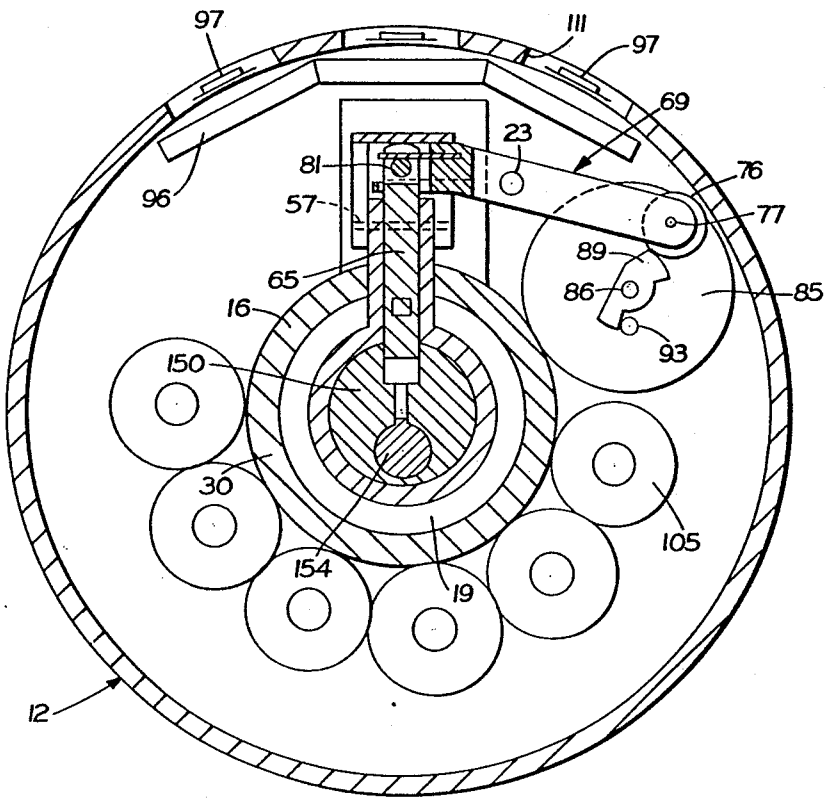
FIG. 18 is a sectional view taken on line 8—18, FIG. 17.

A third embodiment of the improved locking device is shown particularly in FIGS. 17, 18 and 19 and is indicated generally at 147. Device 147 is similar in many respects to locking device 1 described above, except it is intended for use with a fixed turnkey or other mechanical turning mechanism instead of a removable security key, such as key 47 of locking device 1. Modified device 147 includes a fixed turnkey 148 which is slideably, rotatably mounted and trapped within bore 149 of a cylinder plug 150. A usual tail piece 151 is mounted on the inner end of plug 150 and engages the locking mechanism of a usual lockset. Key 147 is retained within the key slot of cylinder plug 150 by a limit pin 152, which extends into a slot 153 formed in key shank 154. A tapered front surface 155 engages the heretofore fifth tumbler pin 52 for actuating detention arm pin 50 in a similar manner as described above with respect to device 1. Key 148 is spring biased in an outward direction by a compression coil spring 157, which biases key 148 to the position shown in FIG. 17.

The operation of locking device 147 is broadly defined as follows. First, the user pushes in the turnkey from the position of FIG. 17 to that of FIG. 19 and then allows it to spring back. This action awakens the computer and actuates the electronic mode of the improved locking device similar to that described above with respect to locking device 1. The user again pushes in the fixed turnkey and while it is held in this inward position, as shown in FIG. 19, it can be rotated to unlock the door since locking pin 65 will have been moved to the unlocked position by the upward movement of lever arm 69. Likewise, tumbler pin 52 has been moved to the unlocked position, as shown in FIG. 17, by its seating in a holding pocket 158 formed in the forward end of key shank 154. When the fixed turnkey is rotated back to its home position, it will spring outwardly to the position of FIG. 17 when released by the user. This will inform the computer to relock the electronic part of the device, that is, to re-engage locking pin 65 within cylinder plug 150.

A more detailed operation of modified locking device 147 is as follows. As the turnkey is pushed inwardly, it compresses return spring 157 and drives pins 52 and 50 upwardly. The turnkey shoulder 159 abuts against cylinder face 160 preventing any further inward movement of the key. At this time the bottom of pin 52 is seated in holding pocket 158 and, at the same time, the pin detention arm 56 has been lifted and the limit switch 49 has triggered and the computer is awakened. Upon a signal being received that the computer is awake, key 148 is released and it is returned by spring 157 to its outer position of FIG. 17.

Pin 50 and 52 then move downwardly and the limit switch is opened telling the computer that this part of the procedure is completed. The computer then is waiting for the correct code to be entered on the keypad. When the correct code is entered, the computer then turns the cam and the locking pin 65 moves upwardly and disengages from cylinder plug 150. To unlock the door at this point in time, a simple push on the turnkey and partial rotation thereof, as if it were a standard key, will actuate tail piece 151 and the associated locking mechanism (not shown) engaged therewith. The holding pocket 158 prevents the turnkey from being pushed out by the return spring until the turnkey has been turned back to home position. The computer then will relock or engage the locking pin within the cylinder plug. Turnkey 148 is prevented from being pushed totally out of the cylinder plug by spring 57 by limit pin 152 and the limit slot 153 in which it is engaged.

Embodiment 147 of the improved locking device thus provides a device which relies entirely upon the electronic verification of an input code for its security and does not require the use of a security locking key for operation of the lock. It requires the user only to have the correct code, and then by the normal manual manipulation of turnkey 148 or other mechanical device, enables the locking mechanism to be moved to an open position for unlocking the door in the usual manner. Again, the third embodiment is self contained within doorknob 10 which is easily retrofitted on a usual lockset as are devices 1 and 115 described above.

Figure 21:
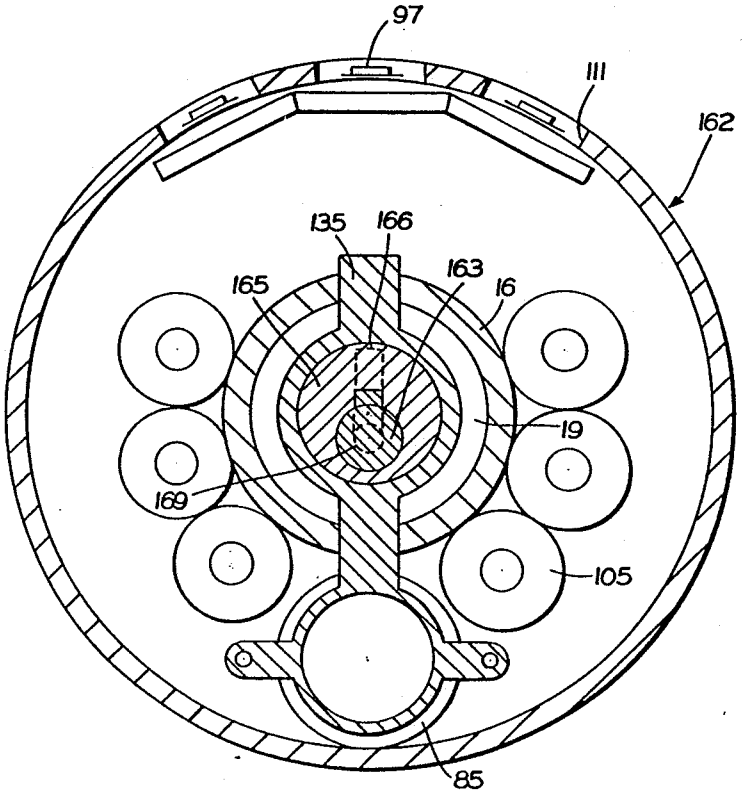
FIG. 21 is a sectional view taken on line 21—21, FIG. 20.
Figure 22:
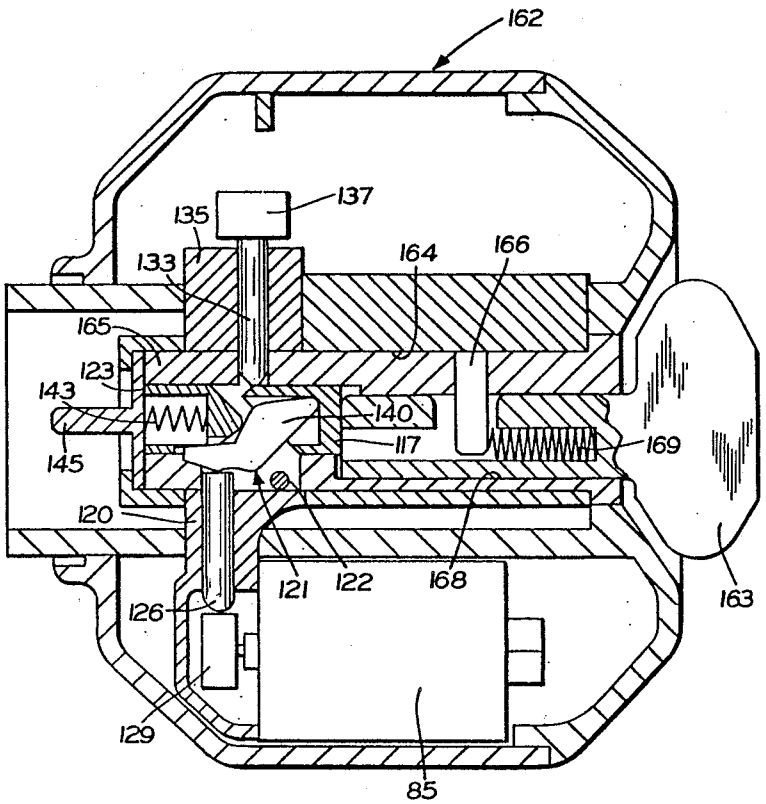
FIG. 22 is a diagrammatic sectional view similar to FIG. 20 showing the turnkey in a fully inserted position just prior to release of the locking pin by the electronically controlled mechanism.
Figure 20:
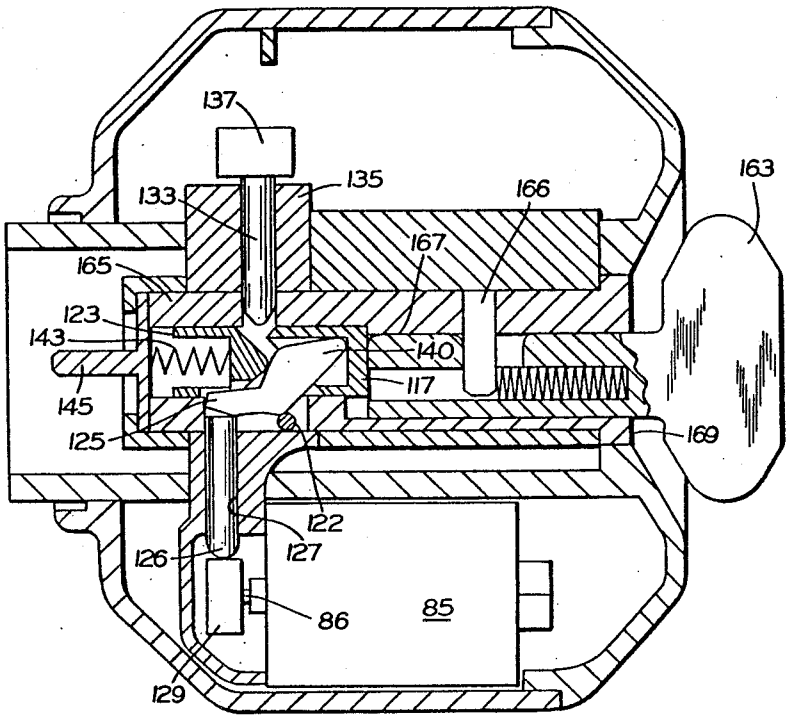
FIG. 20 is a diagrammatic sectional view similar to FIG. 17 showing a fourth embodiment of the improved locking device in locked position which is electronically controlled by an access code and then mechanically actuated by a nonremovable turnkey.

A further modified locking device or fourth embodiment is indicated generally at 162, and is shown particularly in FIGS. 20, 21 and 22. Embodiment 162 is similar in many respects to second embodiment 115 shown in FIGS. 12–15. Therefore, this fourth embodiment is not described in great detail since the operation thereof is similar to that described above for locking device 115. The main difference between embodiment 162 with respect to that of embodiment 115 is the use of a trapped turnkey 163 which is slideably mounted within bore 164 of cylinder plug 165. Key 163 is retained within the cylinder plug by a pin 166, which extends into a slot 167 formed in key shank 168. Turnkey 163 is engaged by a return spring 169, which biases key 163 to the outward or locked position of FIG. 20.

The operation of modified locking device 162 is similar to that described above with respect to locking device 115 and to that described above with respect to third embodiment 147 of the locking device. Broadly, the user pushes inwardly on key 163 which moves key slide 117 inwardly to actuate limit switch 137 through upward movement of limit switch pin 133. Upon motor 85 receiving the correct signal from the computer when the correct code is entered into keypad 95, it will rotate cam 129 enabling locking pin 126 to be removed from its engagement with leg 125 of rocker lever 121.

Again, the main difference between fourth embodiment 162 and second embodiment 115 is the use of a trapped turnkey 163 or other type of mechanical turning mechanism, instead of a removable security key as used when the double lock and security feature of embodiments 1 and 115 are incorporated into the locking device. Modified locking device 162 provides an electronically actuated device as does embodiment 147 with the mechanical portion thereof being used only to rotate the cylinder plug to rotate tail piece 145 for actuation of the locking mechanism upon receiving the correct entry code.

Accordingly, the improved locking device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved locking device is constructed and used, the characteristics of the construction, and the advantageous, new and useful results obtained; the new and useful structures, devices, elements, arrangements, parts, and combinations, are set forth in the appended claims.

What is claimed is:

1. An electromechanical locking device completely contained within a doorknob of the type adapted to be fitted on an input shaft of a key actuated lockset, said device including (a) a self-contained power source;

(b) key actuated mechanical locking means for rotating a locking cylinder from locked to unlocked position;

(c) first means for generating a first signal in response to an entered code;

(d) second means for generating a second signal in response to the first signal and (e) interlocking means operable in response to the second signal for permitting unlocking of the mechanical locking means by a key.

2. The locking device defined in claim 1 in which the power source is a battery.

3. The locking device defined in claim 2 in which audible signal means is operatively connected to the battery for generating an alarm upon the power output of the battery dropping to a predetermined level.

4. The locking device defined in claim 3 in which the audible signal means generates a ready indication signal upon insertion of a correct key into the mechanical locking means.

5. The locking device defined in claim 1 in which the first means is a keypad containing a plurality of switches.

6. The locking device defined in claim 1 in which visual signal means is provided on the doorknob for providing a visual signal upon the power level of the power source dropping to a predetermined level.

7. The locking device defined in claim 1 in which the interlock means includes a locking pin engageable with the cylinder to prevent rotation thereof, and a motor actuated cam operatively connected to said locking pin by a linkage assembly for disengaging said locking pin from said cylinder.

8. The locking device defined in claim 7 in which the locking pin is biased by the linkage assembly into locking engagement with the cylinder.

9. The locking device defined in claim 8 in which the motor actuated cam engages the linkage assembly to maintain the locking pin in locking engagement until the second signal is received by the interlock means.

10. The locking device defined in claim 9 in which a key actuated pin is engageable with the linkage assembly to overcome the bias of the linkage assembly and move the locking pin toward disengagement from the cylinder; and in which the cam is rotated by the motor out of engagement with the linkage assembly upon receiving said second signal whereby the linkage assembly can move the locking pin out of locking engagement with said cylinder upon engagement of said key actuated pin by a key inserted into the cylinder.

11. The locking device defined in claim 7 in which the linkage assembly includes a pivotally mounted spring biased pin detent arm and a pivotally mounted lever arm operatively connected thereto, said lever arm being connected at one end to the locking pin and engageable at an opposite end by the motor actuated cam.

12. The locking device defined in claim 11 in which at least one of a pluralilty of tumbler pins is engageable with the pin detent arm for pivoting said arm to a raised position upon engagement of said one tumbler pin by a key to move the locking pin to an unlocked position by its connection with the lever arm.

13. The locking device defined in claim 7 in which the motor operated cam is disengaged from the linkage assembly when the power level of the self-contained power source drops to a predetermined level permitting rotation of the locking cylinder without the second signal being generated by the second means.

14. The locking device defined in claim 1 in which the second means is a computer; and in which a code is stored in said computer and is compared against the first signal generated by the first means to determine if a valid code was entered.

15. The locking device defined in claim 1 in which the interlock lock means includes a locking pin engageable with the cylinder to prevent rotation thereof and a motor operated cam operatively engageable with said locking pin for disengaging said locking pin from said cylinder.

16. The locking device defined in claim 1 including switch means for generating a third signal in response to insertion of the key into the mechanical locking means.

17. The locking device defined in claim 16 in which the interlock means further includes slide means adapted to be actuated by the key, said slide means engageable with a slideably movable pin for actuating the switch means.

18. The locking device defined in claim 17 including a lever actuated by the slide means, said lever being engageable with a lock pin to move said lock pin out of locking engagement with the mechanical locking means upon the interlock means receiving the second signal.

19. The locking device defined in claim 16 in which the second means is a computer; and in which the third signal generated by the switch means is supplied to the computer indicating that a key has been inserted into the mechanical locking means.

20. An improved door lockset of the type having an inside knob and an outside knob connected by a lock body mounted through the door, said lock body having a locking bolt and a rotating member for unlocking said lock bolt, said improved lockset including:

(a) a self-contained power source mounted within the outside knob;
(b) a key actuated cylinder mounted within said outside knob connected to the rotating member for unlocking said lock bolt upon turning the cylinder with a key;
(c) code generating means mounted on the outside knob for generating a coded signal in response to manual operation of said code generating means;
(d) memory means mounted within the outside knob and connected to the power source for generating a control signal in response to receiving a valid coded signal from the code generating means; and
(e) interlock means operable in response to the control signal permitting turning of the cylinder by the key to unlock the lock bolt.

21. The improved door lock set defined in claim 20 in which the interlock means includes a locking pin engageable with the cylinder to prevent rotation thereof, and a motor actuated cam operatively connected to said locking pin by a linkage assembly for disengaging said locking pin from said cylinder.

22. The improved door lock set defined in claim 21 in which the locking pin is biased by the linkage assembly into locking engagement with the cylinder.

23. The improved door lock set defined in claim 22 in which the motor actuated cam engages the linkage assembly to maintain the locking pin in locking engagement until the second signal is received by the interlock means.

24. The improved door lock set defined in claim 23 in which a key actuated pin is engageable with the linkage assembly to overcome the bias of said linkage assembly and move the locking pin toward disengagement from the cylinder; and in which the cam is rotated by the motor out of engagement with the linkage assembly upon receiving said second signal whereby the linkage assembly can move the locking pin out of locking engagement with said cylinder upon engagement of said key actuated pin by a key.

25. An electromechanical locking device completely contained within a doorknob of the type adapted to be fitted on an input shaft of a key actuated lockset, said device including (a) a computer;
(b) a motor controlled by said computer;
(c) battery means for supplying power to the computer and motor;
(d) a keypad connected to the computer for entering a code in the computer;
(e) a key actuated mechanically operated lock cylinder; and
(f) interlock means between the motor and lock cylinder for permitting operation of the mechanically operated lock cylinder by the key upon the computer receiving a proper code from the keypad.

26. The locking device defined in claim 25 in which the interlock means includes a locking pin engageable with the cylinder to prevent rotation thereof, and a motor actuated cam operatively connected to said locking pin by a linkage assembly for disengaging said locking pin from said cylinder.

27. The locking device defined in claim 26 in which the motor actuated cam engages the linkage assembly to maintain the locking pin in locking engagement with the lock cylinder until the second signal is received by the interlock means.

28. The locking device defined in claim 27 in which a key actuated pin is engageable with the linkage assembly to overcome the bias of the linkage assembly and move the locking pin toward disengagement from the cylinder; and in which the cam is rotated by the motor out of engagement with the linkage assembly upon receiving said second signal whereby the linkage assembly can move the locking pin out of locking engagement with said cylinder upon engagement of said key actuated pin by a key manually inserted into the lock cylinder.

29. A locking device completely contained within a doorknob of the type adapted to be fitted on an input shaft of a mechanically actuated lockset having a locking cylinder, said device including:

(a) a self-contained power source;
(b) a mechanical actuated turnkey slideably rotably mounted within the locking cylinder for rotating the locking cylinder from locked to unlocked position;
(c) first means for generating a first signal in response to an entered code;
(d) second means for generating a second signal in response to the first signal;
(e) interlock means operable in response to the second signal for permitting manual movement of the mechanical actuated turnkey for rotating the cylinder to the unlocked position; and
(f) switch means actuated upon inward movement of the turnkey for generating a third signal enabling the generation of the first and second signals.

30. The locking device defined in claim 29 in which the turnkey is spring biased to an outward position; in which inward movement of said turnkey moves a locking pin to an unlocked position; and in which the turnkey is retained within the locking cylinder by a limit pin engaged within a slot formed in a shank of said turnkey.

31. An electronically operated locking device completely contained within a doorknob of the type adapted to be fitted on an input shaft of a lockset, said device including (a) a computer;
(b) a motor controlled by said computer;
(c) battery means for supplying power to the computer and motor;

(d) a keypad connected to the computer for entering a code in the computer;

(e) a mechanically operated lock cylinder; and (f) interlock means between the motor and lock cylinder for permitting manual operation of the mechanically operated lock cylinder upon the computer receiving a proper code from the keypad.

32. The locking device defined in claim 31 in which the interlock means includes a locking pin engageable with the cylinder to prevent rotation thereof, and a motor actuated cam operatively connected to said locking pin by a linkage assembly for disengaging said locking pin from said cylinder.

33. The locking device defined in claim 32 which the motor actuated cam engages the linkage assembly to maintain the locking pin in locking engagement with the lock cylinder until the second signal is received by the interlock means.

34. A electronically operated locking device completely contained within a doorknob of the type adapted to be fitted on an input shaft of a lockset, said device including:

(a) electronic logic means;

(b) a motor controlled by said electronic logic means;

(c) a self contained power source;

(d) code entry means for entering a code into said electronic logic means;

(e) mechanical means for manually operating the input shaft of a lockset; and (f) interlock means cooperating with the motor and mechanical means for permitting manual operation of the mechanical means upon the electronic logic means receiving a proper code from the code entry means.

* * * * *